US007661556B2

(12) United States Patent
van der Klaauw et al.

(10) Patent No.: US 7,661,556 B2
(45) Date of Patent: Feb. 16, 2010

(54) TAPPING DEVICE AND CONTAINER THEREFOR, AND METHOD FOR THE MANUFACTURE THEREOF

(75) Inventors: Guido Petrus Johannes van der Klaauw, Zoeterwoude (NL); Bart Jan Bax, Den Haag (NL); Marius Corstiaan van Duuren, Poortugaal (NL)

(73) Assignee: Heineken Technical Services B.V., Amsterdam (NL)

( * ) Notice: Subject to any disclaimer, the term of this patent is extended or adjusted under 35 U.S.C. 154(b) by 409 days.

(21) Appl. No.: 10/297,071

(22) PCT Filed: May 29, 2001

(86) PCT No.: PCT/NL01/00414

§ 371 (c)(1),
(2), (4) Date: Sep. 8, 2003

(87) PCT Pub. No.: WO01/92144

PCT Pub. Date: Dec. 6, 2001

(65) Prior Publication Data

US 2004/0069368 A1 Apr. 15, 2004

(30) Foreign Application Priority Data

May 31, 2000 (NL) ..... 1015359

(51) Int. Cl.
*B67B 7/00* (2006.01)

(52) U.S. Cl. ..... 222/1; 222/105; 222/129.1; 222/131; 222/146.6; 222/183; 222/399; 62/389

(58) Field of Classification Search ..... 222/1, 222/146.6, 105, 129.1, 129.2, 129.3, 183, 222/131, 400.7, 400.8, 386.5, 394, 399, 396; 62/389, 399

See application file for complete search history.

(56) References Cited

U.S. PATENT DOCUMENTS

| | | | |
|---|---|---|---|
| RE20,981 | E | 1/1939 | Riesgo |
| 2,257,070 | A | 9/1941 | Perlick |
| 2,262,043 | A | 11/1941 | Perlick |

(Continued)

FOREIGN PATENT DOCUMENTS

| | | | |
|---|---|---|---|
| DE | 41 30 715 | C | 8/1992 |

(Continued)

OTHER PUBLICATIONS

Johnson Enterprises, Inc., "1999 Beverage Dispensing Equipment Catalog", Wholesale Edition, 1999, pp. i-ii, 1-57, iii.

(Continued)

*Primary Examiner*—Frederick C. Nicolas
(74) *Attorney, Agent, or Firm*—Pearne & Gordon LLP

(57) ABSTRACT

A tapping device (1) for beverage, including a cooling device and a tapping rod (8) with a tapping cock (14), the tapping rod including a first (50) and a second (52) channel, which channels are in fluid communication with each other adjacent the tapping cock (14), while at least during use a tapping line (48) extends through the second channel, which tapping line is coupled at one end with a container (6) for beverage and at the other end can cooperate with the tapping cock.

13 Claims, 8 Drawing Sheets

U.S. PATENT DOCUMENTS

| | | | | | |
|---|---|---|---|---|---|
| 2,325,228 | A | | 7/1943 | Cornelius | |
| 2,377,261 | A | | 5/1945 | Norris | |
| 2,446,895 | A | * | 8/1948 | Weiss | 62/224 |
| 2,506,843 | A | | 5/1950 | Seiler | |
| 2,638,758 | A | * | 5/1953 | Daun | 62/394 |
| 2,749,930 | A | * | 6/1956 | Whitnall | 137/212 |
| 2,771,752 | A | | 11/1956 | Tennant | |
| 2,792,692 | A | * | 5/1957 | Bryan | 62/306 |
| 3,248,009 | A | | 4/1966 | Sutton et al. | |
| 3,625,399 | A | | 12/1971 | Heisler et al. | |
| 3,889,487 | A | | 6/1975 | Frankfurt | |
| 4,148,352 | A | | 4/1979 | Hayashi et al. | |
| 5,062,548 | A | * | 11/1991 | Hedderick et al. | 222/190 |
| 5,079,927 | A | * | 1/1992 | Rodino et al. | 62/99 |
| 6,105,825 | A | * | 8/2000 | Gomi et al. | 222/146.6 |

FOREIGN PATENT DOCUMENTS

| | | | |
|---|---|---|---|
| DE | 29604703 | | 7/1996 |
| DE | 298 20 793 | U1 | 5/1999 |
| EP | 0 224 293 | A | 6/1987 |
| EP | 0 246 052 | | 11/1987 |
| GB | 396 637 | A | 8/1933 |
| GB | 396637 | | 8/1933 |
| GB | 484952 | | 6/1937 |
| GB | 484952 | | 5/1938 |
| SE | 516679 | | 6/1999 |
| WO | WO 99/11561 | A1 | 3/1999 |
| WO | 00 03944 | | 1/2000 |
| WO | 0000423 | | 1/2000 |
| WO | WO 01/92144 | A2 | 12/2001 |

OTHER PUBLICATIONS

Johnson Enterprises, Inc., "1990 Beverage Dispensing Equipment Catalog", Wholesale Edition, 1989, pp. i-ii, 1-57, iii.

* cited by examiner

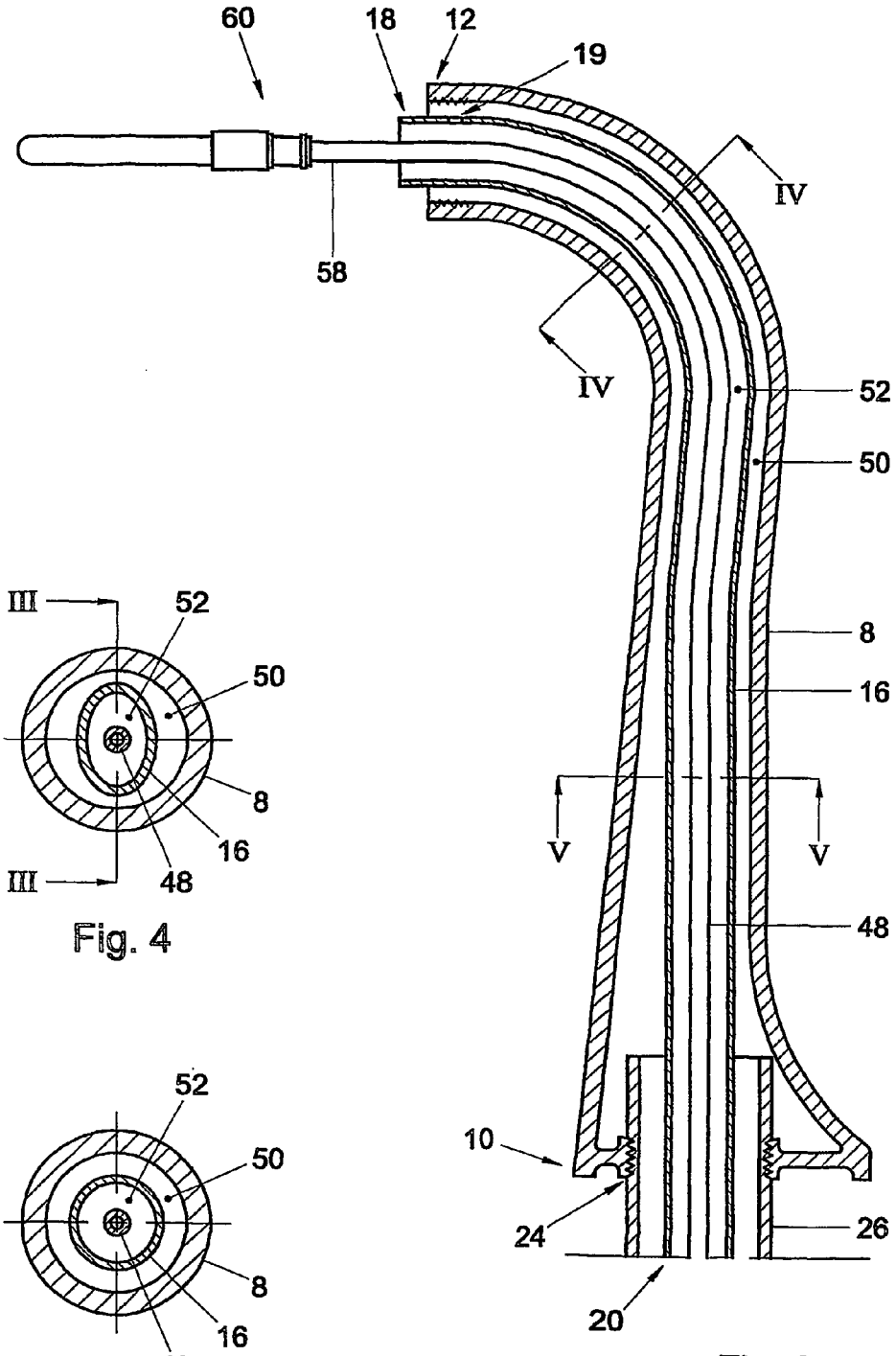
Fig. 3
Fig. 4
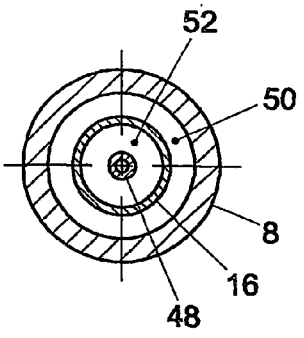
Fig. 5

TAPPING DEVICE AND CONTAINER THEREFOR, AND METHOD FOR THE MANUFACTURE THEREOF

This application was published in English on Dec. 6, 2001 as International Publication Number WO 01/92144 A2.

FIELD OF THE INVENTION

The invention relates to a tapping device. The invention relates in particular to a tapping device comprising a tapping rod with a tapping line extending therethrough in use. Such a tapping device is known from EP 0 224 293.

BACKGROUND OF THE INVENTION

This known tapping device comprises a refrigerator having therein a number of containers for beverage. Placed on the refrigerator is a hollow tapping rod, through which extends a tapping line. This tapping line is coupled with the back of a conventional tapping cock mounted on the tapping rod, so that beverage can be forced from the container to the tapping cock, for instance under the influence of $CO_2$ gas introduced into the container. The hollow tapping rod is in open communication with the inner space of the refrigerator, so that in principle relatively cold air can flow from the refrigerator into the tapping rod and can envelop the tapping line therein. During use, this leads to cooling of the tapping line and beverage flowing therethrough.

This known tapping device has as a disadvantage that the air in the tapping rod will substantially not move. In fact, the cooled air will be warmed in the tapping rod and, as a result, be forced further upwards in the tapping rod, since the warmer air is relatively light with respect to the cold air present in the refrigerator. In the tapping rod, adjacent the tapping cock, a relatively small opening is provided, through which a part of the air can escape. This improves the air movement in the tapping rod, but entails the drawback that in the surroundings of the tapping cock an undesired, relatively cold air stream will arise, precisely in the direction of the tapping cock and the person operating this tapping cock, while moreover relatively much energy will be lost, since the escaped, relatively cool air in the refrigerator will be replaced by relatively warm air drawn in from the surroundings, which will have to be cooled from, for instance, room temperature to a temperature of, for instance, about 4 to 6 degrees Celsius.

The object of the invention is to provide a tapping device of the kind described in the preamble, wherein the disadvantages mentioned are avoided, while maintaining the advantages thereof. To that end, a tapping device according to the invention is characterized by the features set forth herein.

SUMMARY OF THE INVENTION

In a tapping device according to the present invention, the two channels which are in fluid communication with each other form a continuous channel through which a cooling medium can be passed. Due to the tapping line extending through one of the channels, in particular the second channel, cooling of the tapping line will then occur in the respective channel. This means that during use, beverage flowing from the container through the tapping line to the tapping cock will be properly cooled. Since circulation of the cooling medium through the first and second channel is possible, this will simply prevent the cooling medium from undesirably escaping in undesired amounts through, at least along, the tapping cock.

In a further elaboration, a tapping device according to the invention is further characterized by the features set forth herein.

In contrast with the known tapping device, cooling medium will be recycled, so that a flow of cooling medium, in particular air, can be obtained. Then, moreover, substantially no cooling medium is lost, at least not along the tapping cock. Any hindrance to a user will thereby be limited to a minimum, or even be prevented altogether.

By including the guide tube within the tapping rod, between the tapping rod and the guide tube the first channel is formed, which, at least adjacent the tapping cock, is in fluid communication with the second channel, which is formed by, at least in, the guide tube. As a result, during use, a flow can be obtained through the guide tube and the channel formed, such that a tapping line received within the guide tube is thereby circumfused. By passing a cooled medium, in particular air, through the first and second channel, a forced cooling of the tapping line, and beverage being passed therethrough, is thereby obtained.

Preferably, forcing means are provided for forcing cooling medium through the channels. In that case, the flow does not exclusively depend on natural convection. These forcing means can function by creating an excess pressure adjacent the inlet of the first or second channel, but preferably, during use, a reduced pressure is created adjacent the outlet of the channel located downstream in the desired direction of flow, so that cooling medium is sucked through the channels. This is advantageous in particular because in the event of small leaks in either of the channels, merely air will be sucked in from the surroundings, and cooling medium will be prevented from flowing to the surroundings, so that hindrance to users is limited still further.

In a particularly advantageous embodiment, a tapping device according to the invention is further characterized by the features set forth herein.

The use of air cooled in the refrigerator provides the advantage that cooling medium, of a desired temperature, has been obtained in a particularly simple manner. What is thereby prevented in a simple manner is that great temperature differences arise between the temperature of, at least around, the tapping line in the refrigerator and in the tapping rod. It is then preferred that the cooled air is first passed through the second channel and is led back from the tapping cock via the first channel in the direction of the refrigerator. Preferably, air is then recirculated from the refrigerator via the channels to the refrigerator, for instance along an evaporator or other cooling means of the refrigerator, for readjusting the temperature of the air. Energetically, this is particularly advantageous, since relatively little energy is required for cooling the air slightly warmed in the tapping rod. Use of air then additionally provides the advantage that any leakage to the surroundings will not lead to contamination, so that no particularly complex seals need to be provided.

In a particularly advantageous embodiment, a tapping device according to the invention is further characterized by the features sey forth herein.

As described, it is preferred that use is made of reduced pressure for creating a flow through the channels. Application of a reduced pressure chamber, in fluid communication with the first channel, provides the advantage that through the reduced pressure chamber, air, at least cooling medium, will be drawn in from the first channel, which has as a result that, to equalize a pressure difference, air will also be drawn in through the second channel. Upon connection of the second air channel to the inner space of a refrigerator, this has as a consequence, for instance, that a forced air flow is obtained from the refrigerator to the reduced pressure chamber. In the reduced pressure chamber, during use, a reduced pressure with respect to the surroundings can be created by means of, for instance, a fan, with which, from the reduced pressure chamber, air can be forced along cooling means back into the refrigerator, for the purpose of cooling containers disposed therein and for recirculation through the channels.

It is preferred that the first and second channel are in fluid communication with each other in the tapping cock. In this way, during use, cooling takes place over a maximum length of the tapping line. The tapping rod and optionally the guide tube are preferably thermally insulating, for instance through the provision of a thermally insulating layer. What is thereby prevented is that during use the tapping rod has an undesirably cold feel and that unnecessary warming of the cooling medium flowing through the first channel arises as a result of ambient heat. Thermal insulation of the guide tube then provides the advantage that heat exchange between cooling medium flowing through the first and the second channel is limited, which is of benefit to the cooling of the tapping line.

In a further advantageous embodiment, a tapping device according to the invention is further characterized by the features set forth herein.

Constructing the tapping line as an at least partly flexible hose, adapted to be coupled to the tapping cock, provides the advantage that fitting the tapping line is easily possible. In fact, it can be readily passed through the guide tube, for instance from an open end remote from the tapping cock, as far as the tapping cock, where the hose and the tapping cock can be coupled. This readily enables exchange of a tapping line for a different tapping line, for instance each time when a new container is broached. Preferably, containers are used with a flexible tapping line connected thereto, which is supplied along with the container, is temporarily passed through the guide tube, and is coupled to the tapping cock, such that the beverage can be dispensed from the container via the tapping cock, whereafter, when removing the container, the tapping line is uncoupled from the tapping cock and the tapping line is removed along with the container. As a result, cleaning the tapping line is not necessary anymore, while contamination can be simply prevented. This is advantageous especially when the containers are disposed relatively close to the tapping cock, for instance in a refrigerator set up under a tap on which the tapping rod is mounted.

In a tapping device according to the invention, the tapping cock can be designed such that, together with at least a flexible part of the tapping line, it can form a hose cock, such that the flexible part, under elastic deformation, can be squeezed shut with the tapping cock and the passage of the tapping line can be cleared again through operation of the tapping cock.

It is preferred, however, that in the tapping line a valve is included, which can be operated by means of the tapping cock, between an open and a closed position. In the embodiments described here, the advantage is achieved that also the tapping cock cannot come into contact with the beverage to be dispensed, so that contamination of the tapping cock by the beverage is simply prevented, while moreover contamination of the beverage through contact with the tapping cock is also prevented. Preferably, the tapping line is so designed that the free end thereof, through which the beverage is dispensed during use, extends outside the tapping cock when the tapping line is coupled with the tapping cock, so that in this way too the tapping cock is prevented from coming into contact with the beverage.

In a further particularly advantageous embodiment, a tapping device according to the invention is further characterized by the features set forth herein.

In such a tapping device, the tapping rod and the guide tube extend through a tapping platform on which they are mounted and through a wall of the refrigerator, so that a simple, direct coupling between tapping platform and refrigerator is obtained. The distance between the refrigerator and the tapping cock is thereby reduced to a minimum, yielding relatively short channels. Moreover, the length of the guide tube is thereby rendered relatively short, which is advantageous in particular when the at least partly flexible tapping line is to be passed therethrough, from the inner space of the refrigerator into or near the tapping cock. This means that feed-through of the tapping line is further simplified. Preferably, the tapping rod is fixedly connected with the guide tube, the guide tube extending through the reduced pressure chamber and being fixedly mounted against the underside thereof, whereby at the same time the tapping rod is secured. For that purpose, for instance, the guide tube can be provided with screw thread on which a nut can be turned as far as against the reduced pressure chamber. Also, the reduced pressure chamber may be provided with screw thread capable of cooperating with thread on the guide tube, for fastening. Variations thereon will be immediately clear to one skilled in the art.

Within a refrigerator to be used for a tapping device according to the invention, preferably at least two set-up positions for containers are provided, while between the set-up positions, at least between containers disposed therein, separation means are provided which are thermally insulating. What is achieved with such separation means, in particular, is that a container already cooled is separated, for instance, from a relatively warm container to be placed later on, which is to be cooled in the refrigerator for subsequent use. What is thereby prevented is that the container already cooled is warmed up by the relatively warm container. What can also be achieved thereby is that air is passed through the channels substantially from near the container already cooled. The separation means can be fixedly arranged in the refrigerator, but can also, for instance, be partly connected with the door thereof.

Further, a tapping device according to the present invention can be characterized by the features set forth herein.

Such a tapping device provides the possibility of regular replacement of the tapping line, preferably together with each container to be used therewith. This means that the tapping line, in principle, does not need to be cleaned anymore, but can be fitted and removed along with the container. In that case, each time a new, at least other, container, is fitted, the tapping line is replaced, so that, for instance, mixing of beverages is simply prevented, and a clean line is provided at all times, which is particularly hygienic. Moreover, the costs of cleaning are saved. If desired, the tapping line may, of course, be cleaned, which can then take place at a distance from the tapping device, so that the tapping device needs to be out of operation only for a minimal time, viz. during replacement of container and tapping line. This is advantageous in particular when relatively small kegs are used as containers, having a contents of, for instance, 10, 20 or 30 liters. The first end of the tapping line, in leading position during insertion, can be coupled with the tapping cock, while the trailing, second end serves for forming a connection with the container. For that purpose, this second end may be adapted to be coupled to the container, for instance by means of a rapid coupling, but it is preferred that the tapping line is fixedly connected with the container, such that it cannot be separated therefrom without damaging it. This ensures hygiene still more. During insertion of the tapping line into a guide tube in a tapping device according to the present invention, the leading, first end is preferably covered by means of a covering cap with a rounded top. The effect thus achieved is that the open, leading end of the tapping line itself is protected against ingressive dirt, which is important in particular because this end, during feed-through, will be passed through the inside of the guide tube, for instance through one or more bends. A rounded top of the covering cap then provides the advantage that guidance of the tapping line is thereby improved considerably, so that the tapping line can be particularly simply fed through. A tapping device according to the invention is thereby improved still further, both as to hygiene and ergonomics.

The invention further relates to a method for arranging a tapping device, characterized by the measures set forth herein.

With such a method, in a simple manner, a tapping device can be formed, in which, at least during use, a tapping line extends through the guide tube as far as the tapping cock, which tapping line is surrounded within the guide tube by a channel. This channel can be connected with a further channel extending between the guide tube and a wall of the tapping rod, such that a cooling medium can be passed through the two channels, thereby flowing around at least a large part of the tapping line. In this description, as cooling medium, a gaseous cooling medium, in particular air, is described. It will be clear, however, that other cooling media can be used as well, for instance a cooling liquid such as water. Air is preferred, for the reasons described earlier.

In a method according to the present invention, the tapping rod can be fixed directly onto a refrigerator, with, for instance, the top of the refrigerator forming a tapping platform. However, it is preferred that the tapping rod is mounted on a tapping platform, such that at least the guide tube extends through the tapping platform and a wall, in particular the top, of a refrigerator disposed under it, such that a fluid communication is created between the inner space of the refrigerator and the inner space of the guide tube. It is then particularly advantageous when the tapping rod also extends at least beyond the wall of the refrigerator, while on the inside of the wall a chamber is provided which is in fluid communication with the channel between the guide tube and the tapping rod, but is separate from the inner space of the guide tube. Such a chamber can be designed, for instance, as a reduced pressure chamber, such that air is sucked from the inner space of the refrigerator through the two channels into the reduced pressure chamber and from there can be passed to cooling means.

It will be clear that a flow of cooling medium through the channels can also be obtained in a different manner, for instance in that separate air cooling means are placed between the two channels, and the tapping line is coupled with a container disposed at a greater distance, the tapping line being preferably thermally insulated insofar as it extends outside the guide tube.

The invention further relates to a method for manufacturing a tapping rod, characterized by the measures set forth herein.

With such a method, in a particularly simple manner, a tapping rod can be manufactured, which is suitable in particular for use with a device or method according to the invention. By making use of a guide tube as insert, which is cast-in in a tapping rod, a guide tube of a desired configuration can be obtained in a particularly simple manner, without the tube having to be subsequently introduced. This leads to a considerably increased freedom in design for both the guide tube and the tapping rod, while the number of assembly operations is considerably reduced.

The invention further relates to a container for beverage, characterized by the features set forth herein.

Such a container is particularly suitable for use in a tapping device and method according to the present invention, since the at least partly flexible hose enables the tapping line to be fitted and removed particularly simply. The primary valve then prevents the possibility of beverage flowing into the tapping line prior to use. This means that less stringent requirements need to be imposed on the barrier properties of the tapping hose. Moreover, the tapping hose can have an open end. It is preferred that in or on the tapping hose a valve is provided which, as described earlier, can be coupled to the tapping cock, for cooperation therewith, which valve can close or open the passage of the tapping line. This simply prevents the possibility of beverage flowing away. In such a design, the primary valve, at least between the container and the tapping line, can, in principle, be omitted. It is preferred, however, that in such an embodiment too, a primary valve is provided, in order to prevent oxidation of beverage still better.

In the further subclaims, further advantageous embodiments of a tapping device, method and container according to the invention are described in more detail.

BRIEF DESCRIPTION OF THE DRAWINGS

To clarify the invention, exemplary embodiments of a tapping device, method and container will be further described with reference to the drawings. In the drawings:

FIG. 3 is a sectional side elevation of a portion of a tapping rod according to the invention with a tapping line therein, with the tapping cock removed, sectioned along the line III-III in FIG. 4;

FIG. 4 is a cross section of a tapping rod along the line IV-IV in FIG. 3;

FIG. 5 is a cross section of a tapping rod along the line V-V in FIG. 3;

DETAILED DESCRIPTION OF THE PREFERRED EMBODIMENTS OF THE INVENTION

Figure 1:
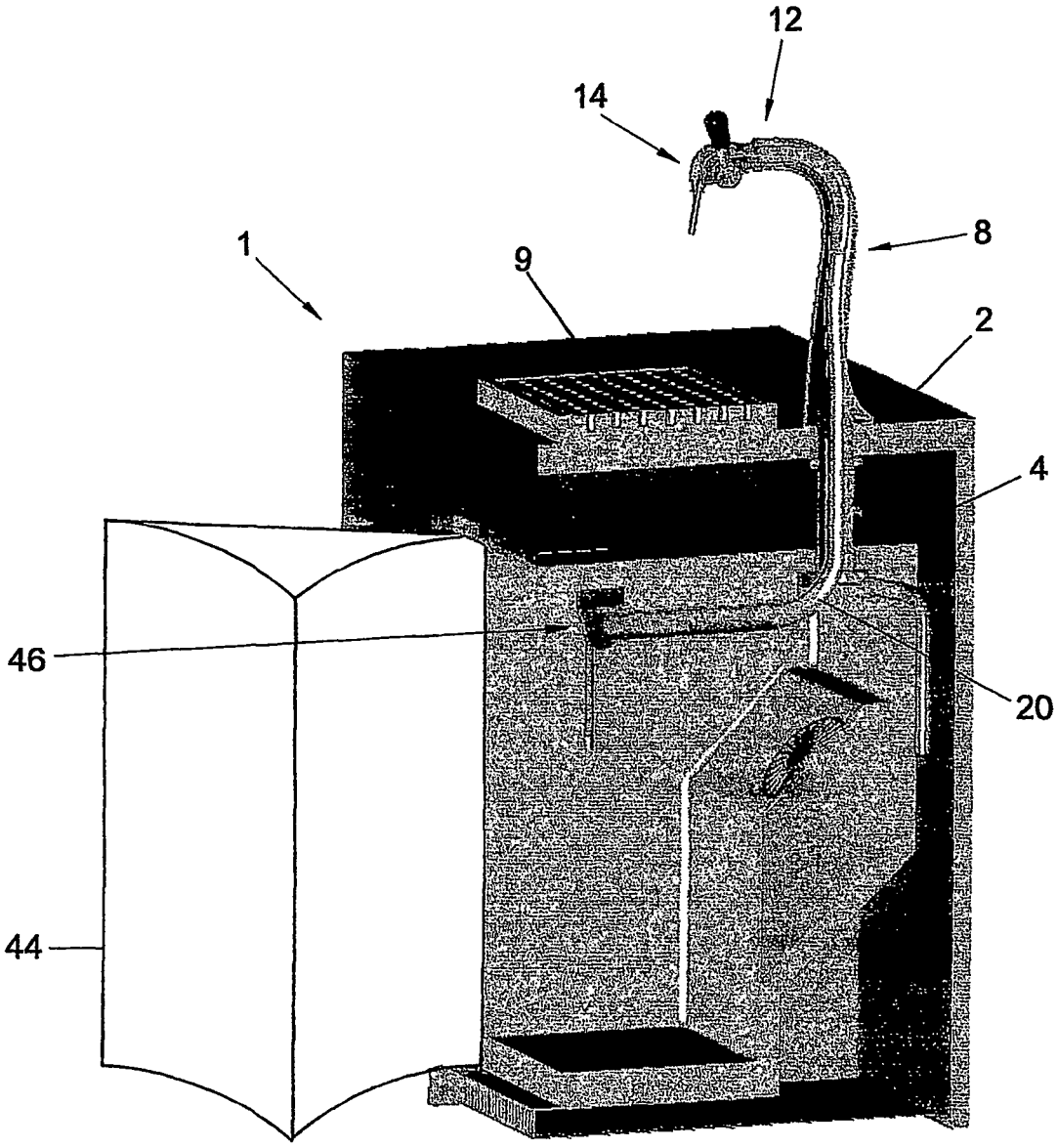
FIG. 1 is a partly cutaway, perspective view of a tapping device according to the present invention.

In this description, the same or corresponding parts have the same or corresponding reference numerals. In this description, at least with regard to the tapping cock and a valve body or shut-off valve cooperating therewith, reference is made to applicant's Dutch patent application entitled "Beverage dispensing assembly and container for carbonated beverage and beverage dispensing duct for use in such an assembly", filed on the same date, which application is understood to be incorporated herein by reference. Further, with regard to containers applicable in a device according to the present invention, reference is made to international patent application PCT/NL99/00454 in the name of applicant, the contents of which are incorporated herein by reference.

Figure 10:
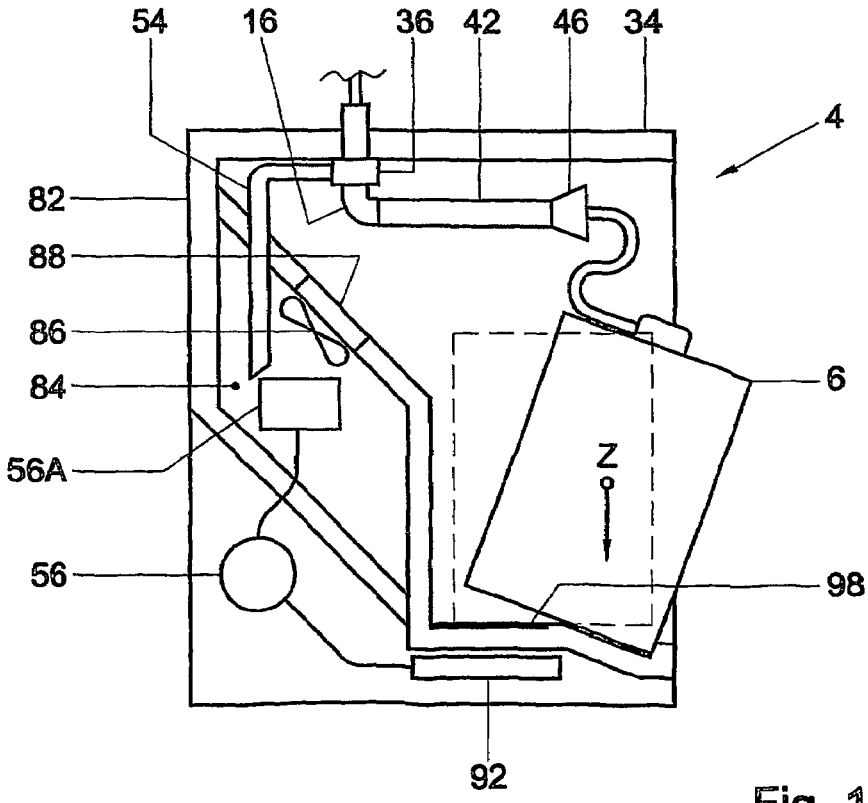
FIG. 10 is a sectional side elevation of a device according to FIG. 9.

FIG. 1 shows, in partly sectional, perspective view, a tapping device 1 according to the invention. This tapping device 1 comprises a tapping platform 2, for instance a bar, with a refrigerator 4 disposed under it, in which a container 6 can be disposed, for instance as shown in FIG. 10 in broken lines. Mounted on the tapping platform 2 is a tapping rod 8, in a manner shown in more detail in FIG. 2. The tapping rod 8 has a first end 10 resting on the tapping platform 2, while at the opposite, second end 12 a tapping cock 14 is mounted. Such a tapping cock is shown in more detail in FIG. 8 and discussed in the Dutch patent application mentioned earlier. Within the tapping rod 8, as shown in FIG. 3, extends a guide tube 16, which has a first end 18 located adjacent the second end 12 of the tapping rod 8, while the second end 20 of the guide tube 16 reaches beyond the first end 10 of the tapping rod 8, into the inner space 22 of the refrigerator 4. The first end 10 of the tapping rod 8 is provided with an opening with internal thread 24, in which a mounting bush 26 with external thread (not shown) is screwed. This mounting bush 26 reaches through an opening 28 in the tapping platform 2. An assembly nut 30 is screwed on the mounting bush 26 against the underside of the tapping platform 2, such that the tapping rod 8 is fixedly connected with the tapping platform 2. A part of the mounting bush 26 extending under the assembly nut 30 reaches into an opening 32 in the top 34 of the refrigerator 4. A reduced pressure chamber 36 to be described in more detail hereinafter is screwed with a screw flange 38 in the opening 32 onto the lower end of the mounting bush 26, so that a fixed connection is formed between the refrigerator 4, the tapping platform 2 and the mounting bush 26 with the tapping rod 8. The guide tube 16 extends with clearance through the mounting bush 26, through the bottom 40 of the reduced pressure chamber 36, into the inner space 22. In the exemplary embodiment shown, on the second end 20 of the guide tube 16, a lead-in tube 42 is mounted, which reaches into the front of the inner space 22 of the refrigerator 4, at least as far as near a door 44 of the refrigerator 4. Mounted on the end of the lead-in tube 42 remote from the guide tube 16 is a slightly funnel-shaped lead-in element 46, open towards the inner space 22. The tapping rod 8 and/or the guide tube 16 are preferably of thermally insulating design, for instance through the provision of a lining or the use of thermally insulating material for the tapping rod 8 and/or the guide tube 16.

During use, there extends through the guide tube 16 and the lead-in tube 42 a tapping line 48, from the inner space 22 to a point beyond the first end 18 of the guide tube 16. This tapping line 48 can be arranged fixedly in the tapping rod 8, but is preferably at least partly of flexible design, such that it can be introduced through the guide tube 16 and be pulled out again in a manner to be further described hereinafter. During use, a first channel 50 is formed between the guide tube 16 and the wall of the tapping rod 8, and a second channel 52 is formed between the wall of the guide tube 16 and the tapping line 48. With the tapping cock mounted, the first channel 50 is in fluid communication with the second channel 52 in, at least adjacent, the tapping cock 14. This means that, during use, a fluid, in particular air cooled in the refrigerator 4, can flow through the lead-in element 46, along the tapping line 48 in the second channel 52 and from there via the inner space of the tapping cock 14 into the first channel 50. From the first channel 50, the cooling medium, in particular the cooled air, then flows into the inner space of the reduced pressure chamber 36, from where it can flow away via a discharge line 54. It will be clear that in this way cooled air is passed from the inner space 22 through the second and first channels 52, 50, thereby circumfusing, in the second channel 52, the part of the tapping line 48 extending therein and cooling the beverage flowing therethrough. The cooled air is subsequently discharged via the reduced pressure chamber 36 and the discharge line 54 to cooling means 56 of the refrigerator 4, as schematically shown in FIG. 10, and subsequently led back to the inner space 22 of the refrigerator 4. Adjacent the upper, first end 18 of the guide tube 16, bores 19 may be provided, so that a greater flow can be realized, thereby improving the cooling action. Also, the contact surface of the tapping line 48 can be enlarged, for instance through corrugations or the like.

In the cock 14, on the side proximal to the tapping rod 8, a conical wall 61 is provided, which simplifies the insertion of the tapping line 48 and moreover provides for an improved communication between the two channels 50, 52. For that matter, the wall 61 may also be located further up in the cock 14, closer to the outflow end 64. The guide tube 16 can then extend into the cock 14 to a point near the wall 61, so that a part of the portion of the tapping line 48 extending in the cock 14 is cooled as well.

Figure 8:
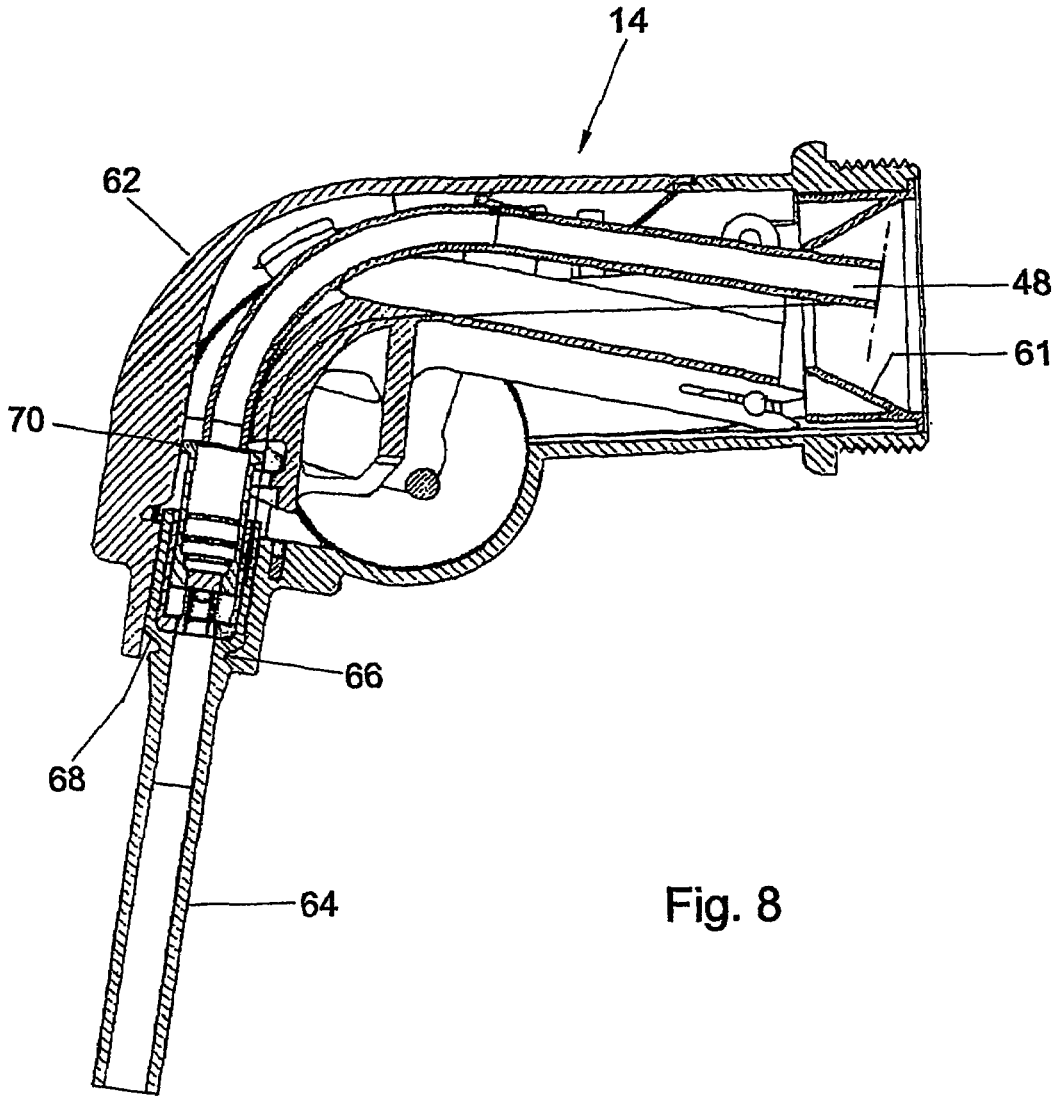
FIG. 8 is a schematic sectional side elevation of a tapping cock according to the invention with inlaid tapping line.

The first end 58 of the tapping line 48 is provided with a valve assembly 60 capable of cooperating with the tapping cock 14, as shown schematically in FIG. 8 and further described in applicant's Dutch patent application mentioned earlier, entitled "Beverage dispensing assembly and container for carbonated beverage and beverage dispensing duct for use in such an assembly". As appears clearly from FIG. 8, the valve assembly comprises an outflow 64 operatively extending outside the tapping cock housing 62, which outflow 64 is mounted in the tapping cock housing 62 by means of a projection 66 engaging in a circumferential groove 68 in the outflow 64. The tapping valve housing 62, after the outflow 64 has been fitted, is substantially completely airtight. Air flowing from the first channel 50 will therefore not be able to leave the tapping cock housing 62 otherwise than via the second channel 52, along the tapping line 48. The outflow 64 is provided, on the side located within the tapping cock housing 62, with a movable body 70 which is operable by an operating mechanism of the tapping cock 14, such that the body 70 can be moved linearly relative to the outlet 64, between a first position wherein beverage can be dispensed through the tapping line 48 and the outflow 64, and a second position, shown in FIG. 8, wherein the outflow 64 is closed off from the tapping line 48 and therefore no beverage can be dispensed. Owing to the outflow 64 reaching beyond the tapping cock housing 62, this tapping cock housing 62 will not come into contact with the beverage. The tapping cock housing 62 is of divisible design, such that in a divided position the tapping line 48, in particular the outflow 64, at least the valve assembly 60, can be laid in, or can be removed, while only when the tapping cock housing 62 is closed, the operating mechanism of the tapping cock 14 can be operated for releasing the fluid communication between the tapping line 48 and the outflow 64.

Figure 2:
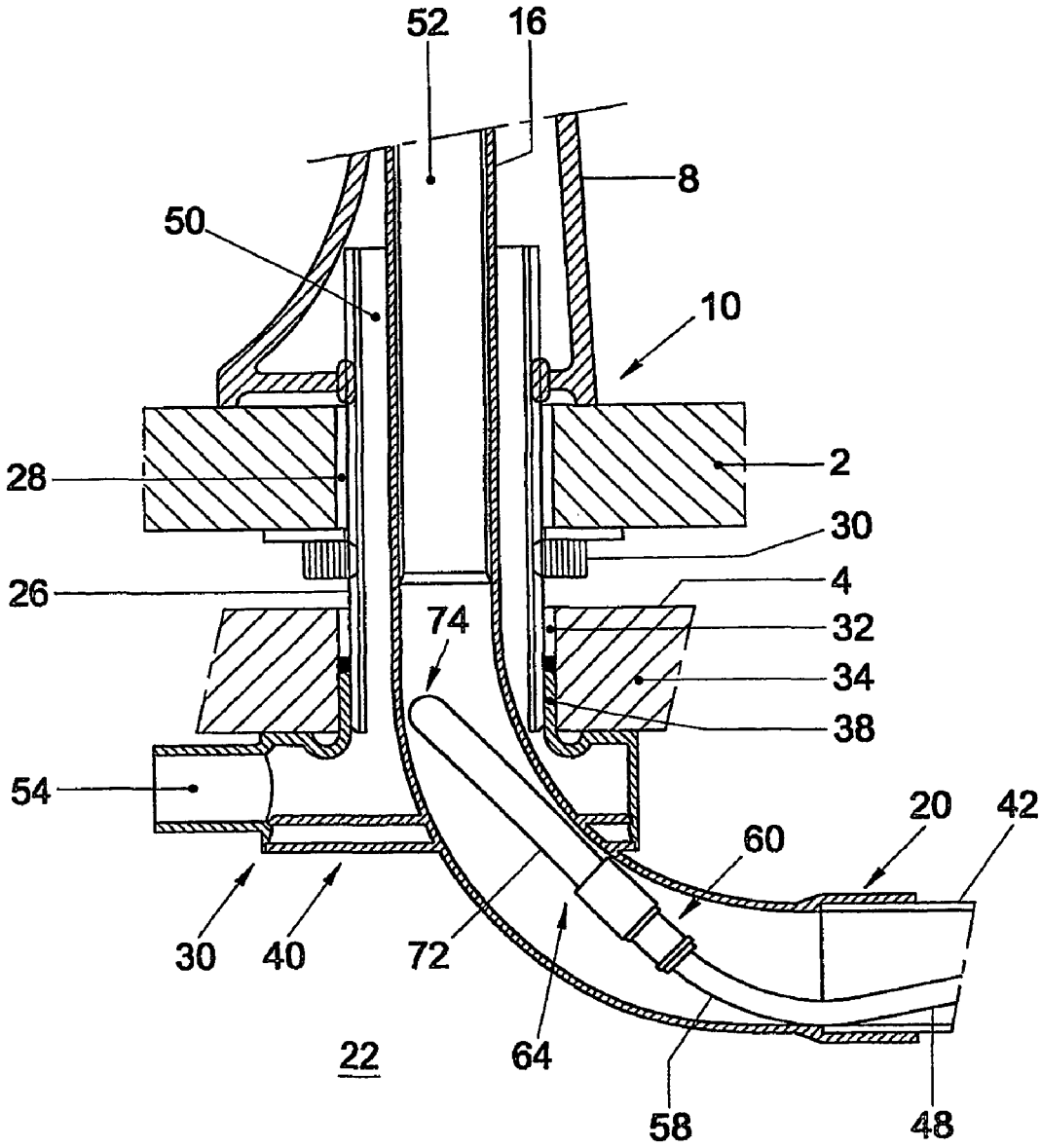
FIG. 2 is a detailed sectional side elevation of the assembly of a tapping rod in a device according to FIG. 1.

In FIG. 2 it is schematically shown in sectional side elevation how a cooled tapping line 48, with the first end 58 leading, can be passed through the guide tube 16. The outflow 64 is covered by a covering cap 72 with a rounded top 74, thereby preventing the covering cap 72, at least the feed-through line 48, getting stuck in the guide tube 16. The length of the covering cap 72, the valves 60 and flexibility of the tapping line 48 are adjusted to the bends in the guide tube 16, such that the tapping line 48 can be passed wholly through the guide tube 16, into the position shown in FIG. 3. The guide tube 16 is designed to be largely oval in the bends, as shown in FIG. 4, such that the long axis of said cross section is located in the plane in which the respective bend is located, yielding more space for the feed-through, while yet approximately the same passage area of the first channel 50 and the second channel 52 is maintained. Moreover, as a result, in the bend, a more advantageous flow pattern of cooling medium flowing therethrough is obtained. By the covering cap 72, the open end of the outflow 64 is screened off during feed-through of the tapping line 48, which prevents fouling of the outflow 64. The valve 60 is preferably designed so as to be closed when the covering cap 72 is pressed in the direction of the tapping line 48. This prevents the valve 60 being opened during feed-through.

Figure 9:
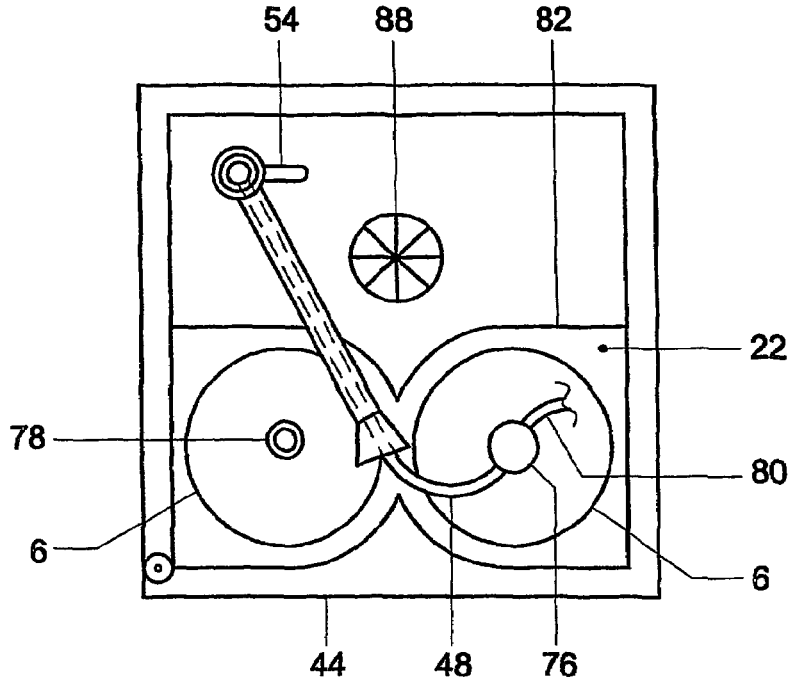
FIG. 9 is a schematic top plan view of a device according to the invention with the top removed.

As appears from FIG. 9, in an advantageous embodiment, two containers 6 can be disposed side by side in the inner space 22 of the refrigerator 4, one of which may be broached, while the other is pre-cooled. In FIG. 9 the container 6 shown on the right-hand side is broached. This means that the tapping line 48 is connected via a tapping head 76 with a primary shut-off valve 78 of the container 6. This primary shut-off valve 78 ensures that the container is fully closed and can only be opened by means of the tapping head 76. From the tapping head 76 extends a supply line 80, connected with a pressure source, for instance a cylinder 81 with compressed $CO_2$, as conventionally used in tapping devices and shown in FIG. 12. However, a container 6 according to the invention may also be constructed, for instance, as described in the international patent applications mentioned earlier, PCT/NL99/00454 or PCT/NL99/00144, which applications are understood to be incorporated herein by reference. In particular, when using a bag-in-container or bag-in-box as container 6, for instance as described in PCT/NL99/00454, a device according to the invention can also be used for non-carbonated beverages, such as juices, dairy and the like, and for pre- and post-mix soft drinks. By connecting the tapping head 76 to the primary valve 78, the possibility is afforded of supplying beverage from the container 6 through the tapping line 48 to the tapping cock 14. In the embodiment shown, the back wall 82 and the door 44 are provided with a profiling, such that the back wall 82 and the door 44 virtually touch each other between the two containers 6, so that these are at least thermally insulated with respect to each other to some extent. Other thermal insulation means can be used for this purpose as well.

Figure 13:
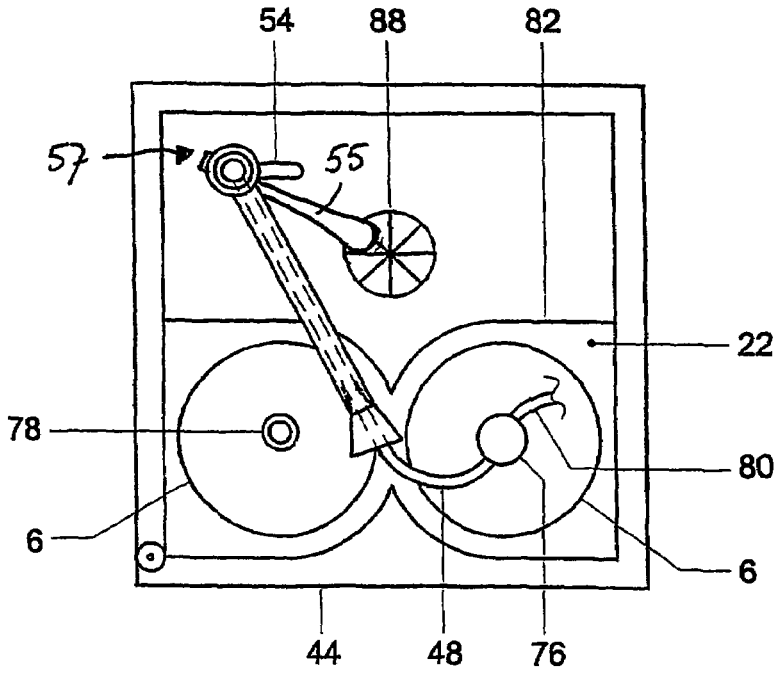
FIG. 13 shows a further embodiment according to the invention.
Figure 13:
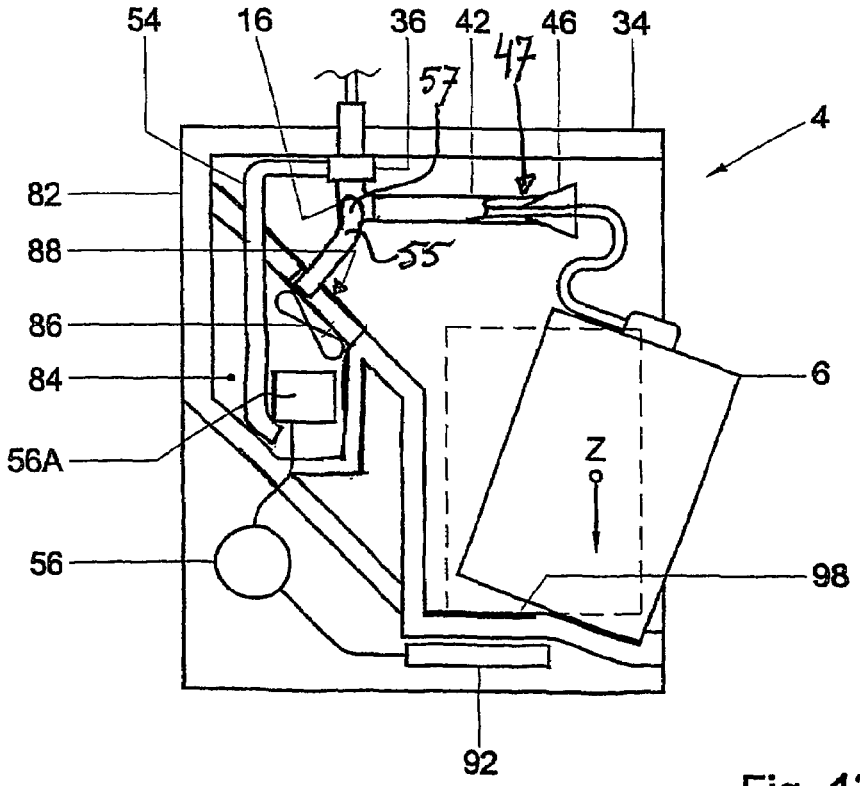

As appears in particular from FIGS. 1, 10 and 13, in the back wall 82 of the refrigerator 4 a space 84 is provided, in which cooling means 56A are disposed, as well as a fan 86, which, during use, blows in the direction of an opening 88 connecting the space 84 with the inner space 22. In the space 84 terminates the discharge line 54, preferably adjacent to or in the cooling means 56A. Upon drive of the fan 86, air will therefore be forced from the space 84 into the inner space 22, as a result of which air will be sucked in from the reduced pressure chamber 36 via the discharge line 54, which creates a reduced pressure in the reduced pressure chamber 36. As a result of this reduced pressure, air will be drawn from the first channel 50, which has as a result that via the tapping cock 14 air is drawn from the second channel 52. Since the two channels 50, 52 and the tapping cock 14 are designed to be substantially completely airtight during use, the air sucked in from the second channel 52 will come from the inner space 22. The discharge line 54 is preferably so dimensioned that air coming out of it can pass the fan 86 only via the cooling means 56A, so that the air passed into the inner space 22 is cooled to the desired temperature, for instance between 0 and 6° C. Thus, air is recirculated and kept relatively cold, so that condensation is at least largely prevented.

Figure 11:
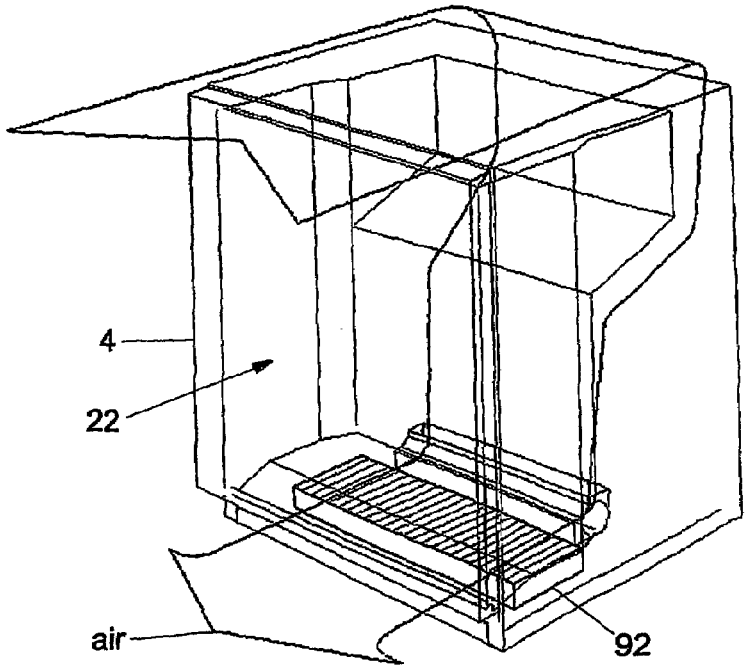
FIG. 11 is a schematic perspective view showing an air flow through a refrigerator for use within the invention.

In the embodiment shown in FIG. 10, under the bottom plate 90 of the refrigerator 4, an evaporator 92 is disposed. The refrigerator 4 is arranged under a tapping platform 2, such that air can be sucked in along the upper side and the back of the refrigerator 4 and can be discharged along the evaporator 92 under the refrigerator 4, as schematically shown in FIG. 11. Preferably, the bottom 90 is so designed that it can be opened for cleaning the evaporator 92. It will be clear, however, that other cooling mechanisms, known from practice, can be applied as well.

A tapping device 1 according to the invention can be built up as follows.

On a tapping platform 2 a suitable position for a tapping rod 8 is chosen, for instance depending on the position of a tapping grid 9 or rinsing sink. Next, at the desired position, an opening 28 is drilled in the tapping platform 2. The refrigerator 4 is disposed at a suitable position under the tapping platform 2, and in the refrigerator top 34 an opening 32 is drilled, corresponding to the opening 28. The mounting bush 26 is screwed into the collar 38 of the reduced pressure chamber 36 and inserted through the opening 32, and the assembly nut 30 is screwed between the top 34 and the tapping platform 2 onto the mounting bush 26. The tapping rod 8 is screwed, by the first end 10 thereof, onto the upper end of the mounting bush 26, such that the tapping platform 2 is locked between said first end 10 and the assembly nut 30. As a result, a fixed connection is obtained between the tapping platform 2 and the refrigerator 4. Naturally, any desired, suitable order of assembly can be used. The lead-in tube 42 can then, through rotation of the reduced pressure chamber 36, be oriented such that the lead-in element 46 is brought in a suitable position with respect to the door 44, for instance centrally of the refrigerator 4, at least viewed in front view. It is then preferred that the discharge line 54 is at least partly of flexible design, so that it can be led into the space 84 in any position of the reduced pressure chamber 36. The tapping cock 14 is screwed onto the end 12 of the tapping rod 8.

A container 6, with a tapping line 48 connected, at least connectible, thereto, can be placed from the front in the inner space 22, on the bottom 90. The bottom 90 may be profiled such that the container 6 can be positioned in an upright position, wholly within the inner space 22, as shown in FIG. 10 in broken lines, but also in a slightly tilted position, as shown in FIG. 10 in solid lines, with the primary valve 78 located adjacent the front of the refrigerator 4 and being readily accessible for mounting the tapping head 76, if necessary. The center of gravity Z is then located such that the container 6 by itself remains standing on the bottom 90. Next, the tapping line 48, with the top 74 leading, is moved into the lead-in element 46 and passed through the guide tube 16, whilst the tapping cock is brought into a divided position. The tapping line 48 is passed through so far that the valve 60 can be laid in the tapping cock 14, while the covering cap 72 can be removed, and the cock 14 can be closed. The optionally tilted container 6 can then be brought into the vertical position and the refrigerator can be closed, whereupon the tapping device 1 is ready for use. The operation of the tapping cock 14 will then lead to beverage being dispensed from the container 6.

When the container 6 has been emptied to the desired extent, a new container 6 can be broached. For that purpose, the primary tapping head 76 can be transferred to a new container 6, but it is preferred that the tapping line 48 is removed entirely and is replaced by a new tapping line with shutoff valve 60. To that end, the tapping cock 14 can be divided and the tapping line 48 can be retracted in the direction of the inner space 22 or, if the tapping line 48 is detached from the tapping head 76, be pulled in its entirety out of the guide tube 16 via the tapping cock 14. Thus, the tapping line is configured to be disposable and replacing the tapping line 48 provides the advantage that hygiene is ensured still better and mixing of beverages is prevented. If the tapping line 48 in a device 1 according to the invention is received relatively fixedly in the guide tube 16, it may also be fixedly connected with the tapping cock 14 and in each case the tapping head 76 can be connected to a new container 6, after it has optionally been cleaned in a manner known per se.

Figure 6:
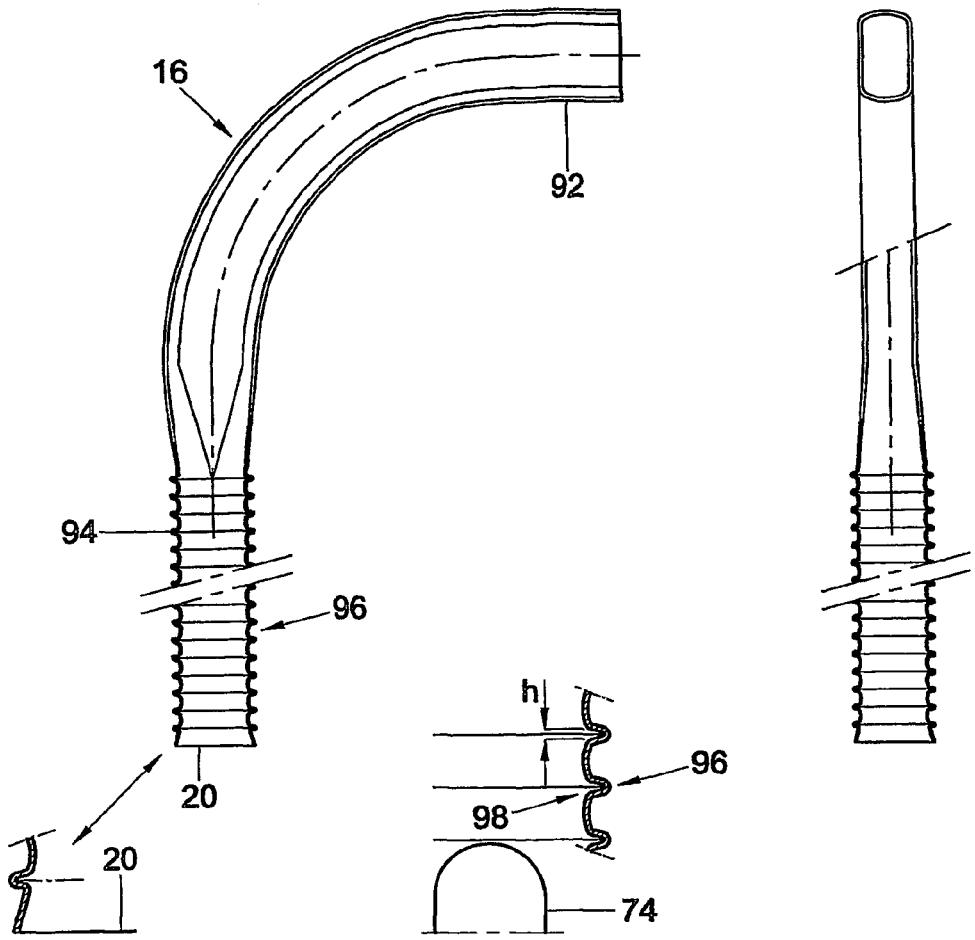
FIG. 6 shows a front and a side elevation, respectively, of a guide tube for use in a tapping rod according to FIG. 3, with a few details.

A guide tube 16 according to the invention can be designed to be, for instance, wholly or partly flexible, in plastic, as schematically shown in FIG. 6. Such a guide tube can be mounted, for instance, in a metal tapping rod 8, which tapping rod can be, for instance, an existing type of tapping rod. In this application, tapping rod, usually also referred to as countermount, beer engine, tapping column, and the like, should be understood to mean at least a portion of a tapping device mounted on a tapping platform. In this embodiment, the guide tube 16 is provided with a bend 92, which is of relatively stiff design, with a flattened, oval cross section, to which bend 92 connects a flexible, corrugated part 94. The corrugations 96 of the flexible part 94 are designed so as to extend outwards. The inwardly directed circumferential grooves 98 here have a height H which is considerably smaller than the rounding of the top 74 of the covering cap 72, thereby preventing still better the possibility of the top 74 getting stuck in the flexible part 94 during feed-through of the tapping line 48. The lower end 20 of the guide tube 16 is made of slightly flaring design, so that introduction of the top 74 is readily possible. In such an embodiment, the guide tube 16 can, for instance, be introduced from the second end 12 of the tapping rod 8, allowing the flexible part to be pushed relatively easily through the tapping rod 8 until the bend 92 has been brought into the desired position.

Figure 7:
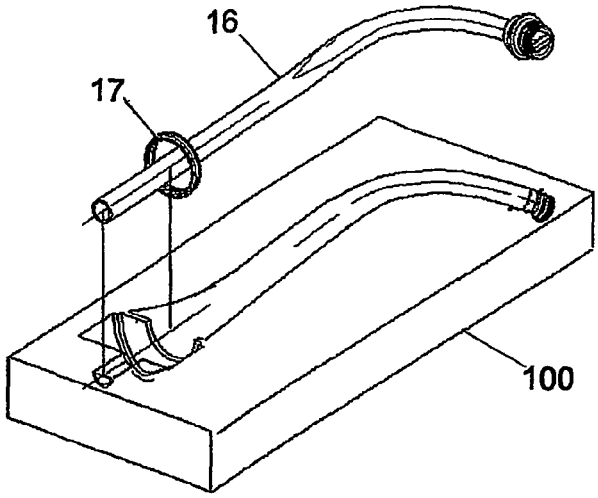
FIG. 7 is a schematic perspective view of a molding die with a guide tube as insert for a tapping rod.

In an alternative embodiment, as shown in FIG. 7, a relatively stiff, for instance metal, guide tube 16, provided with a spacer ring 17, is laid in a molding die 100, of which only one half is shown in FIG. 7. Around the guide tube 16, a lost core having the shape of the first channel 50 is provided, whereafter the tapping rod 8 proper is cast around it, preferably from metal, such as stainless steel, aluminum or the like. Next, the core referred to (not shown), which is formed, for instance, from sand or wax, is removed, insofar as it is not already gone after casting, so that a one-piece tapping rod 8 with guide tube 16 has been obtained, suitable for use. In such an embodiment, the ring 17 can moreover be used for mounting the mounting bush 26, which, for that matter, may also be integrally cast.

In an alternative embodiment, the tapping rod 8 is manufactured from two or more parts, such that the parts can be assembled around the guide tube 16 or an intermediate wall for separating the channels 50, 52. Also, the guide tube 16 can be manufactured in two or more parts and be joined in the tapping rod 8, for instance after the parts have been slipped into the tapping rod from opposite ends. A sealing ring, for instance a fusion ring, can then be used for interconnecting the parts.

Figure 12:
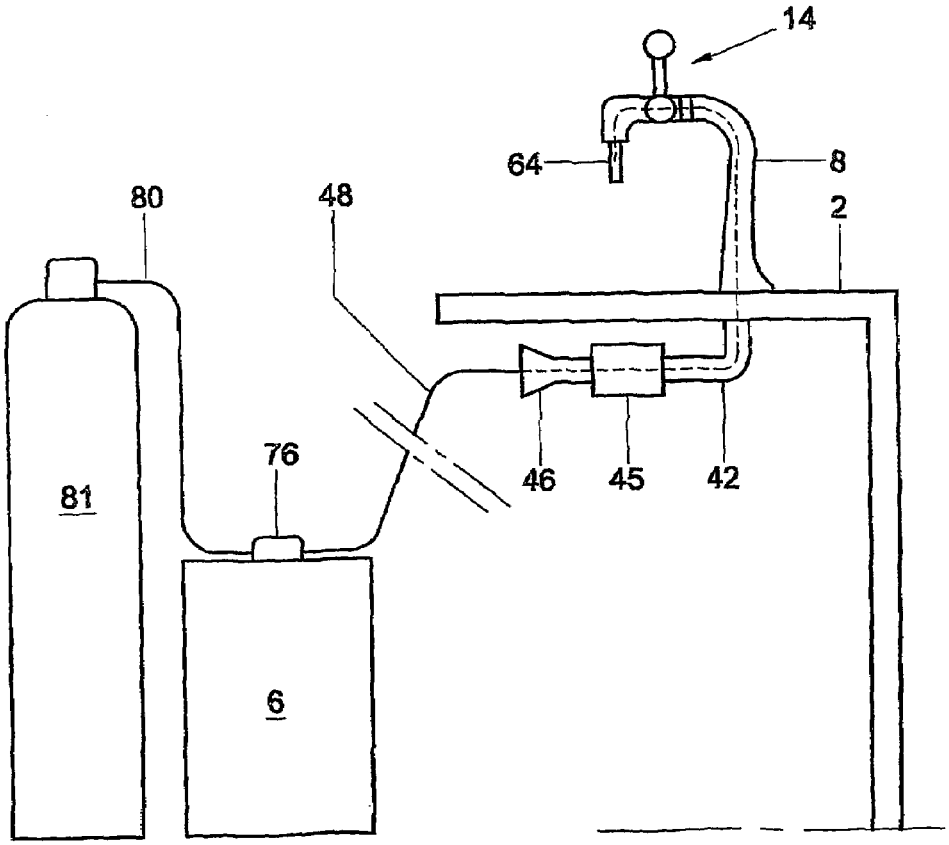
FIG. 12 shows an alternative embodiment according to the invention.

FIG. 12 shows an alternative embodiment of a device 1 according to the invention, wherein the tapping rod 8 has been secured in a conventional manner or as described earlier, on a tapping platform 2 and is provided with at least one channel, for instance formed by a guide tube 16, as described earlier, or by a central bore in the tapping rod. A lead-in tube 42 connects to this channel and is provided with a lead-in element 46, so that a tapping line 48 is passed from under the tapping platform 2 through the lead-in tube 42 and the tapping rod 8 into the tapping cock 14, such that, in the manner described earlier, the outflow end 64 can be fitted. Preferably, adjacent the leading outflow end 64, again a valve 60 is provided, capable of cooperating with the operating mechanism of the tapping cock 14, for instance as described earlier. However, the tapping cock 14 can also be of such design that it can squeeze the tapping line 48 shut adjacent the outflow end 64 or clear it, such that the tapping cock 14 with the tapping line 48 forms a hose cock. In such an embodiment, the outflow end 64 is preferably of relatively stiff design, as in the embodiment described earlier, in order to readily enable positioning of the outflow end 64 and tapping. Naturally, the outflow end 64 can also be an integrated part of the tapping cock 14, in which the end 58 of the tapping line 48 is inserted. Thus it will be understood that the portion of the tapping line located at the tapping cock, in cooperation with the tapping cock, forms a valving arrangement for opening and closing the tapping line to the flow of fluid or beverage through the tapping line. And the valving arrangement can comprise, for example, a hose cock or a valve assembly or body located toward the outflow end of the tapping line.

In the embodiment shown in FIG. 12, the tapping line 48 is connected with a container 6 disposed at a distance from the tapping platform 2, via a tapping head 76. The container 6 may, for instance, together with a $CO_2$ cylinder 81 or comparable pressure source connected thereto via a supply line 80, be disposed in a cellar or the like, or be arranged freely under a tap, that is, outside a refrigerator or like cooling device. Optionally, the lead-in tube 42 can extend to a point close to the tapping head 76. If the lead-in tube 42 is of great length, mechanical means may be provided for easy feed-through of the tapping line 48, for instance hand- or power-driven feed-through rollers or the like. In this embodiment, in, or, as shown, adjacent to, the tapping rod 8, a cooling device 45 is provided, for instance between the lead-in tube 42 and the lead-in element 46, with which the tapping line 48 can be cooled. With such a cooling device, beverage supplied from the container 6, which is preferably disposed at a relatively cool place, can be further cooled to the desired temperature. In particular in the case of beverage that is consumed at a relatively high temperature, for instance between 10° C. and room temperature, such a device is particularly suitable. However, when using suitable cooling means 45, beverages can be dispensed at a lower temperature.

In FIG. 13, a further alternative embodiment of a tapping device according to the invention is shown, which substantially corresponds to that as shown in FIGS. 1 and 10. In this embodiment, where the same parts have the same reference numerals, an air duct 55 is provided, which has a first end terminating in or adjacent the fan 86 and has the opposite end in fluid communication with the lead-in tube 42, at least with the first channel 50. In this lead-in tube 42, preferably adjacent the lead-in element 46, a constriction 47 is included, which is a relatively close fit around the tapping line 48. The constriction 47 can optionally be slightly flexible, such that the leading end of the tapping line 48 with the valve assembly can be moved therethrough under elastic deformation and the constriction abuts against the tapping line. Upon drive of the fan 86, air is thereby forced through the air duct 55, into the first channel 50, whilst the constriction 47 largely prevents cooled air being forced into the inner space 22. In this embodiment, the discharge line 54 has been extended to a point under the cooling means 56A, such that air passed through the discharge line 54 can move only by way of the cooling means 56A to the fan 86 and the air duct 55. As a result of the action of the fan 86, under the cooling means 56A a relatively slightly reduced pressure will be created, so that air is drawn in by the discharge line 54. Optionally, a second fan may be provided, for instance adjacent the lower end of the discharge line 54 or in the reduced pressure chamber 36, or between these, such that a stronger, at least more regulated, suction action is obtained. In that case, in an alternative embodiment, the fan 86 can be omitted.

Surprisingly, it has been found that through regulation of the pressure in the channels 50, 52, in each case a desired cooling can be obtained. If in the first channel 50 an excess pressure is set, an excess pressure will likewise be created in the cock 14, so that the tapping line 48 and the valve means 60 will be cooled in the cock 14 as well. By creating in the second channel 52 a slightly reduced pressure, at least with respect to the pressure in the first channel 50, it is ensured that a proper circulation of air is obtained, and no undesirably large amount of cooled air is pressed out through, at least along, the cock 14. It is then advantageous not to choose this reduced pressure to be too strong, to thereby prevent undesirably much hot air being drawn in from the surroundings by way of the cock 14. Thus an energetically advantageous tapping system is obtained. The desired pressure distribution can be obtained both with a single fan and with more fans.

In the embodiment shown, the lead-in channel 42 is provided, under the reduced pressure chamber 36, with two diametrically opposite stubs 57, to which the air supply duct 55 can be connected. In each case, one of the stubs 57 is in use, while the opposite stub is closed off with a cap or the like. This provides the advantage that the tapping rod 8 can be placed at any desired position on the top of the refrigerator and still the air duct 55 can always be connected in a suitable manner. The reduced pressure chamber 36 is here of rotatable design.

A tapping device according to the invention can be fixedly set up, or be of mobile design, for instance wheeled. Surprisingly, it has been found that a tapping device according to the present invention can have the effect of stirring consumer interest. In particular when a tapping device according to the present invention is used in a relatively hot environment, condensation will occur on the tapping rod 8, so that an attractive, cool appearance is obtained. It has been found that, as a result, a greater turnover is achieved. The cooling means of a tapping device according to the invention are preferably set such that ice formation is prevented while yet a maximum cooling effect is obtained.

It will be clear that in a device according to the invention, the tapping line 48 can be discarded with the container 6 and the optional valve 60, after use, or, after cleaning, can be reused. Disposal together with the container provides the advantage that hygiene is better ensured, in particular when the outflow end 64 is also integrated and is discarded along with the tapping line 48, since this prevents the occurrence of contact between the beverage and the tapping device. The use of a valve 60 then provides the advantage that it can be closed before the tapping line 48 is removed, in particular retracted, which prevents residues ending up in the tapping device during removal as well. As in a device according to the invention the beverage is supplied through a removable tapping line 48 and therefore the beverage does not come into contact with the tapping device proper, time and costs for cleaning are saved, while moreover environmentally unsound chemicals do not need to be used. A further advantage of a device according to the invention, in which the tapping line 48 is cooled, is that the beverage can remain at a standstill in the line for a longer time without it becoming unsuitable for consumption. Further, as a result of the prevention of contact between the tapping device and the beverage, wear of the tapping device is prevented.

The invention is not limited in any way to exemplary embodiments shown in the description and the figures. Many variations thereof are possible within the scope of the invention outlined by the claims.

For instance, the tapping line 48, which is of wholly flexible design in the embodiment shown, can also be designed to be wholly or partly stiff, for instance when it extends permanently in the tapping rod 8, and can have a much greater length, so that the refrigerator, at least the container, can be set up further away, for instance in a cellar. The cooling means can be omitted, use being made exclusively of the feed-through possibility of the tapping line, in particular in view of hygiene, as described earlier. In such an embodiment, optionally the outermost, first channel can be omitted. Also, the tapping rod 8 may be of different design, for instance of divisible design, such that the tapping line 48 can be laid in a thus divided tapping rod, whereafter the tapping rod can be closed around the tapping line 48. The first end 58 of the tapping line 48 can be designed to be connectible to the tapping cock 14 in a different manner, for instance with a rapid coupling which can be inserted in the tapping cock 14, while the valve 60 is of different design or actually omitted, and the tapping cock 14 is designed as a conventional tapping cock. Also, several tapping lines 48 can be led through one tapping rod 8. In the embodiment shown, the guide tube 16 has been designed as a tube which extends through the hollow tapping rod 8. It will be clear, however, that the tapping rod 8 can also be separated, for instance by an intermediate wall, into two channels extending next to each other, while the lead-in tube 42 connects directly to one of the two channels for introducing the tapping line 48 therein. Then, such a partition preferably extends to a point close to the tapping cock 14 and can simply be cast-in in a tapping rod 8. Further, air can be passed directly from the first channel 50 into the inner space 22, where it is then cooled by mixing of cooled air already present in the inner space. Also, cooled air can be sucked in directly from the space 84 into the first channel 50 by forming a suitable connection between them. The tapping rod 8 can be mounted directly onto the top 34 of the refrigerator 4, for instance for use of such a device in the recreational or domestic sphere. A refrigerator 4 according to the invention, of course, can be designed in a variety of different ways, with different cooling mechanisms, for instance, as is conventional, with a compressor, evaporator, cooling means and a pressure vessel. Also, different numbers of containers can be received in such a refrigerator. Also, the forcing means for circulating the air, designed as a fan in the embodiment shown, may, conversely, be arranged for blowing air through the channels 50, 52, thereby generating an excess pressure. The use of a reduced pressure chamber 36, at least the resultant suction of air through the channels 50, 52, however, has the advantage that when the tapping cock 14 is not wholly airtight, air from the surroundings will merely be drawn in, which is more agreeable to a user than air being blown off. However, air may also be blown off along the tapping cock, so that a still greater cooling capacity can be obtained. Preferably, the air is then blown away in a direction not being a hindrance to the users, for instance downwards. Further, other cooling media can be used, for instance water or glycol, when the first and second channel are designed as a closed circuit, in which cooling means for the medium are included and in which the tapping line is at least partly fixedly included.

These and many comparable variations are understood to fall within the scope of the invention as outlined by the claims.

What is claimed is:

1. A method for dispensing a beverage, wherein a container comprising a beverage is provided, said container being provided with a primary valve with coupling means, for coupling to a source for a pressure fluid, while an at least partly flexible tapping hose is connected with said primary valve, wherein said tapping hose is provided, adjacent an end remote from said container, with a secondary valve fixedly connected to said hose which can be repeatedly opened and closed, wherein said container is positioned near a tapping device having a tapping cock, and a guide tube extending through said device towards said tapping cock, wherein at least a part of said at least partly flexible tapping hose is inserted into said guide tube in an insertion direction, said secondary valve facing forward seen in said insertion direction, in the direction of the tapping cock and is coupled with said tapping cock, wherein said beverage is dispensed from said container through said tapping hose and said valve, wherein after removal of at least part of said beverage from said container said tapping hose and said secondary valve are removed from said tapping cock and said guide tube and said container and said tapping hose, including said secondary valve are replaced.

2. A method for dispensing a beverage, wherein a container comprising a beverage is provided, said container being provided with a primary valve with coupling means, for coupling to a source for a pressure fluid, while an at least partly flexible tapping hose is connected with said primary valve, wherein said tapping hose is provided, adjacent an end remote from said container, with a leading end, wherein said container is positioned near a tapping device having a tapping cock, and a guide tube extending through said device towards said tapping cock, wherein at least a part of said at least partly flexible tapping hose is inserted into said guide tube in an insertion direction, said leading end facing forward seen in said insertion direction, in the direction of the tapping cock and is coupled with said tapping cock, wherein said beverage is dispensed from said container through said tapping hose, wherein after removal of at least part of said beverage from said container said tapping hose is removed from said tapping cock and said guide tube and said container and said tapping hose are replaced.

3. A method for dispensing a beverage, wherein a container comprising a beverage is provided, said container being provided with a primary valve, while an at least partly flexible tapping hose is connected with said primary valve, wherein said tapping hose is provided, adjacent an end remote from said container, with a secondary valve fixedly connected to said hose which can be repeatedly opened and closed, wherein said container is positioned near a tapping device having a tapping cock, and a guide tube extending through said device towards said tapping cock, wherein at least a part of said at least partly flexible tapping hose is inserted into said guide tube in an insertion direction, said secondary valve facing forward seen in said insertion direction, in the direction of the tapping cock and is coupled with said tapping cock, wherein said beverage is dispensed from said container through said tapping hose and said valve, wherein after removal of at least part of said beverage from said container said tapping hose and said secondary valve are removed from said tapping cock and from said guide tube, and said container and said tapping hose, including said secondary valve, are replaced.

4. A method according to claim 3, wherein the secondary valve is laid in the tapping cock, for cooperation with an operating mechanism of the tapping cock.

5. A method according to claim 3, wherein the tapping cock cooperates with the secondary valve, such that the secondary valve can be opened and closed by means of the tapping cock for the purpose of clearing a fluid passage from the hose to the surroundings.

6. A method according to claim 3, wherein the container is supplied with the hose with the secondary valve connected thereto.

7. A method according to claim 6, wherein the hose is removed together with the container.

8. A method for dispensing a beverage, wherein a container comprising a beverage is provided, said container being provided with a primary valve, while an at least partly flexible tapping hose is connected with said primary valve, wherein said tapping hose is provided, adjacent an end remote from said container, with a leading end, wherein said container is positioned near a tapping device having a tapping cock, and a guide tube extending through said device towards said tapping cock, wherein at least a part of said at least partly flexible tapping hose is inserted into said guide tube in an insertion direction, said leading end facing forward seen in said insertion direction, in the direction of the tapping cock and is coupled with said tapping cock, wherein said beverage is dispensed from said container through said tapping hose, wherein after removal of at least part of said beverage from said container said tapping hose is removed from said tapping cock and said guide tube and said container and said tapping hose are replaced.

9. A method according to claim 8, wherein said tapping hose has, adjacent the leading end, a secondary valve, which secondary valve is coupled with an operating mechanism of the tapping cock, such that the secondary valve can be opened and closed with the operating mechanism.

10. A method according to claim 9, wherein the secondary valve is laid in the tapping cock, for cooperation with the operating mechanism of the tapping cock.

11. A method according to claim 8, wherein the leading end is positioned in the tapping cock, thus forming a hose cock with an operating mechanism of the tapping cock.

12. A method according to claim 8, wherein the container is supplied with the hose connected thereto.

13. A method according to claim 12, wherein the hose is removed together with the container.

* * * * *

UNITED STATES PATENT AND TRADEMARK OFFICE

CERTIFICATE OF CORRECTION

PATENT NO. : 7,661,556 B2
APPLICATION NO. : 10/297071
DATED : February 16, 2010
INVENTOR(S) : van der Klaauw et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 788 days.

Signed and Sealed this

Thirtieth Day of November, 2010

David J. Kappos

David J. Kappos
*Director of the United States Patent and Trademark Office*